US007639229B2

(12) United States Patent
Tanaka et al.

(10) Patent No.: US 7,639,229 B2
(45) Date of Patent: Dec. 29, 2009

(54) LIQUID CRYSTAL DISPLAY APPARATUS

(75) Inventors: Yukio Tanaka, Kanazawa (JP); Kenji Nakao, Kanazawa (JP)

(73) Assignee: Toshiba Matsushita Display Technology Co., Ltd., Tokyo (JP)

( * ) Notice: Subject to any disclaimer, the term of this patent is extended or adjusted under 35 U.S.C. 154(b) by 602 days.

(21) Appl. No.: 11/554,845

(22) Filed: Oct. 31, 2006

(65) Prior Publication Data

US 2007/0109246 A1 May 17, 2007

(30) Foreign Application Priority Data

Nov. 17, 2005 (JP) ..... 2005-333046

(51) Int. Cl.
*G09G 3/36* (2006.01)

(52) U.S. Cl. ..... 345/101; 345/87

(58) Field of Classification Search ..... 345/87, 345/101

See application file for complete search history.

(56) References Cited

U.S. PATENT DOCUMENTS 4,236,150 A * 11/1980 Chern ..... 345/101
6,927,825 B1 * 8/2005 Koma et al. ..... 349/133
2004/0075635 A1 * 4/2004 Arimoto et al. ..... 345/101
2005/0270282 A1 * 12/2005 Kawaguchi ..... 345/204

FOREIGN PATENT DOCUMENTS

JP 2000-214827 8/2000
JP 2002-107695 4/2002
JP 2002-202491 7/2002

OTHER PUBLICATIONS

U.S. Appl. No. 11/460,414, filed Jul. 27, 2006, Shigesumi Araki, et al.

* cited by examiner

*Primary Examiner*—Amare Mengistu
*Assistant Examiner*—Robert R Rainey
(74) *Attorney, Agent, or Firm*—Oblon, Spivak, McClelland, Maier & Neustadt, L.L.P.

(57) ABSTRACT

A liquid crystal display apparatus comprises a liquid crystal display panel, a temperature sensor which detects temperature of the liquid crystal display panel, and a controller which controls a voltage applied to the liquid crystal display panel. The controller sets a black-insertion ratio to 0% and changes the voltage applied in white-display mode to a voltage equal to or higher than the critical voltage, or sets a black-insertion ratio to a finite value and changes the voltage applied in the white-display mode to a voltage lower than the critical voltage, in accordance with the temperature detected by the temperature sensor.

3 Claims, 5 Drawing Sheets

LIQUID CRYSTAL DISPLAY APPARATUS

CROSS-REFERENCE TO RELATED APPLICATIONS

This application is based upon and claims the benefit of priority from prior Japanese Patent Application No. 2005-333046, filed Nov. 17, 2005, the entire contents of which are incorporated herein by reference.

BACKGROUND OF THE INVENTION

1. Field of the Invention

The present invention relates to a liquid crystal display apparatus for use in liquid crystal television sets, monitors for car-navigation systems, OA apparatuses and mobile apparatuses.

2. Description of the Related Art

Liquid crystal displays are widely used as planar display apparatuses for computers, car-navigation systems and television receivers.

It is proposed that a liquid crystal display panel of OCB-mode be used in liquid crystal displays for television receivers that display mainly moving pictures. This is because the liquid crystal molecules of this panel exhibit good response. See, for example, Jpn. Pat. Appln. KOKAI Publication No. 2002-202491.

The liquid crystal display panel of OCB-mode comprises two substrates, a liquid crystal layer, and transparent electrodes. The liquid crystal layer is held between the substrates. Transparent electrodes are formed on the substrates, and are used as means for applying a voltage Before the power switch of the liquid crystal display having the panel is turned on, the liquid crystal molecules of the liquid crystal layer are aligned in a specific state called splay alignment. When the power switch is turned on, a relatively high voltage is applied between the transparent electrodes for a short time, changing the alignment of the liquid crystal molecules to so-called bend alignment. The use of the bend alignment characterizes the liquid crystal display panel of OCB-mode.

Most liquid crystal display panels of OCB-mode have an active-matrix substrate having a plurality of TFTs. Therefore, the panel can fast respond to input data, reducing the one-frame period to half the conventional one-frame period. For example, Jpn. Pat. Appln. KOKAI Publication No. 2000-214827 and Jpn. Pat. Appln. KOKAI Publication No. 2002-107695 disclose that a signal-display period and a black-display period are set in each one-frame period and the panel is driven, by utilizing the fast response of the panel.

In the liquid crystal display panel of OCB-mode, the liquid crystal molecules are prevented from undergoing inverse transition from bend alignment to splay alignment. That is, a high voltage is applied to the liquid crystal layer for a part of the one-frame period, thus driving the liquid crystal display panel of OCB-mode In the normally-white mode, the high voltage corresponds to a voltage that achieves black display. Therefore, the panel is driven in so-called black-insertion driving, thereby preventing the inverse transition to the splay alignment. Hence, the panel can acquire high transmittance.

However, the transmittance falls when the panel is driven in the black-insertion driving at low temperatures (0° C. or less).

BRIEF SUMMARY OF THE INVENTION

An object of the present invention is to provide a liquid crystal display apparatus that has high transmittance, can be driven without inverse transition, and can maintain the high transmittance even at low temperatures.

To achieve the object, according to an aspect of the present invention, there is provided a liquid crystal display apparatus comprising:

a liquid crystal display panel;

a temperature sensor which detects temperature of the liquid crystal display panel; and a controller which controls a voltage applied to the liquid crystal display panel, the controller being configured to set a black-insertion ratio to 0% and change the voltage applied in white-display mode to a voltage equal to or higher than the critical voltage, in accordance with the temperature detected by the temperature sensor, or to set a black-insertion ratio to a finite value and change the voltage applied in the white-display mode to a voltage lower than the critical voltage, in accordance with the temperature detected by the temperature sensor.

Additional advantages of the invention will be set forth in the description which follows, and in part will be obvious from the description, or may be learned by practice of the invention. The advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiment of the present invention will be described in detail, with reference to the accompanying drawings.

Figure 1:
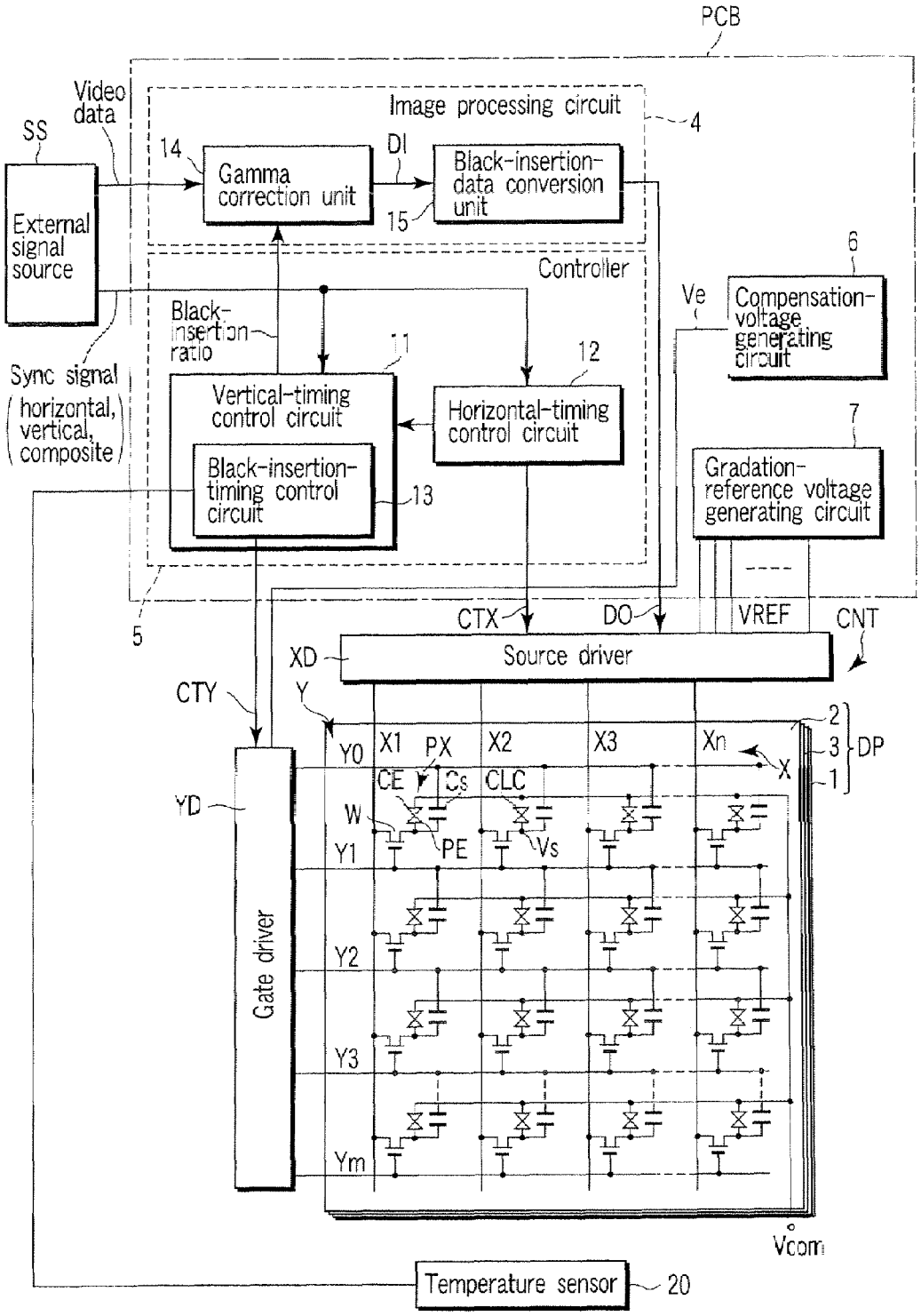
FIG. 1 is a block diagram schematically showing the circuit configuration of a liquid crystal display apparatus according to an embodiment of this invention.

FIG. 1 schematically shows the circuit configuration of a liquid crystal display apparatus according to an embodiment of the present invention. The liquid crystal display apparatus has a liquid crystal display panel DP and a display panel control circuit CNT connected to the liquid crystal display panel DP. The panel DP has an array substrate 1, a counter substrate 2, and a liquid crystal layer 3. The substrates 1 and 2 form a pair of electrodes substrates. The liquid crystal layer 3 is held between these substrates 1 and 2.

The liquid crystal display panel DP is driven in a normally-white and contains an OCB liquid crystal as liquid crystal material. In the normally-white display mode, the liquid crystal molecules of the layer 3 have been transferred from the splay alignment to the bend alignment. A black-display voltage is cyclically applied, thus preventing the inverse transition from bend alignment to splay alignment.

The display panel control circuit CNT controls the transmittance of the liquid crystal display panel DP, by applying a liquid-crystal driving voltage to the liquid crystal layer 3 from the array substrate 1 and counter substrate 2. The transition from splay alignment to bend alignment is achieved by applying a relatively intense electric field to the OCB liquid crystal in the initialization process that the control circuit CNT performs when the power switch of the liquid crystal display is turned on.

The array substrate 1 has a transparent insulating substrate, a plurality of pixel electrodes PE, a plurality of gate lines Y (Y0 to Ym), a plurality of source lines X (X1 to Xn), and a plurality of pixel-switching elements W. The transparent insulating substrate is made of glass or the like. The pixel electrodes PE are arranged in rows and columns on the transparent insulating substrate, forming a matrix. The gate lines Y are arranged, extending along the rows of pixel electrodes PE. The source lines X are arranged, extending along the columns of pixel electrodes PE. The pixel-switching elements W are arranged near the intersections of the gate lines Y and source lines X.

Each pixel switching element W electrically connects one source line X to one pixel electrode PE when it is driven by the gate line Y. The pixel switching elements W are, for example, thin film transistors. Each thin film transistor has its gate electrode connected to one gate electrode Y, its source electrode connected to one source line X and its drain electrode connected to one pixel electrode PE.

The counter substrate 2 includes a transparent substrate, a color filter, and a common electrode CE. The transparent substrate is made of, for example, glass or the like. The color filter is arranged on the transparent substrate. The common electrode CE is arranged on the color filter. The common electrode CE is opposed to the pixel electrodes PE. The pixel electrodes PE and the common electrode CE are made of transparent electrode materials, such as ITO (Indium Tin Oxide) and are covered with alignment films, respectively. The alignment films have been rubbed in parallel directions. The pixel electrodes PE, parts of the common electrode CE and the pixel regions of the liquid crystal layer 3 form pixels PX. In each pixel region of the liquid crystal layer 3, the liquid crystal molecules are aligned in accordance with the electric field applied between the corresponding pixel electrode PE and the common electrode CE.

Each pixel PX has a liquid crystal capacitance CLC between the pixel electrode PE and the common electrode CE and is connected to one end of an auxiliary capacitance Cs. Each of the auxiliary capacitance Cs is a coupling capacitance between the pixel electrode of the pixel PX and the gate line Y that controls the pixel switching element W of the pixel PX provided on one side of this pixel PX. The auxiliary capacitance Cs is much larger than the parasitic capacitance of the pixel switching element W.

The liquid crystal display of FIG. 1 has dummy pixels, which are not shown in FIG. 1. The dummy pixels are arranged around the pixels PX matrix, or the display screen. The dummy pixels have the same configuration as the pixels PX forming the display screen. The dummy pixels are used, imparting the same parasitic capacitance to all pixels PX forming the display screen. The gate line Y0 is a gate line that is opposed to the dummy pixels.

The display panel control circuit CNT includes a gate driver YD, a source driver XD, an image processing circuit 4, and a controller 5. The gate driver YD drives the gate lines Y, one after another, to turn on the switching elements W in units of rows. The source driver XD applies a pixel voltage Vs to the source lines X while the switching elements W of each row remain on.

The image processing circuit 4 processes video data that is cyclically updated, during every one-frame period (i.e., vertical scan period). The video data is gradation data that represents different gradation levels to be presented by the pixels. The controller 5 controls the operation timing of the gate driver YD and that of the source driver XD, in accordance with the video data processed by the image processing circuit 4. The video data is supplied to the image processing circuit 4 from an external signal source SS. At the same time, a sync signal is supplied to the controller 5 from the external signal source SS.

The gate driver YD and the source driver XD are, for example, integrated circuit (IC) chips mounted on a flexible wiring sheet. The flexible wiring sheet is arranged, surrounding the array substrate 1. The image processing circuit 4 and the controller 5 are arranged on an external printed circuit board PCB. The gate driver YD and the source driver XD have shift registers so that they may perform vertical scanning to at lest one of the select gate lines Y, and horizontal scanning to select at least one of the source lines X.

The controller 5 includes a vertical-timing control circuit 11 and a horizontal-timing control circuit 12. The vertical-timing control circuit 11 generates a control signal CTY for the gate driver YD, from the synchronizing signal supplied from external signal source SS. The horizontal-timing control circuit 12 generates a control signal CTX for the source driver XD, from the synchronizing signal supplied from external signal source SS. The vertical-timing control circuit 11 includes a black-insertion-timing controlling unit that adds, to the control signal CTY, data representing the black-inserting timing.

The image processing circuit 4 includes a gamma correction unit 14 and a black-insertion-data conversion unit 15. The gamma correction unit 14 performs gamma correction on pixel data items contained in the image data supplied from external signal source SS and representing different gradation levels. The black-insertion-data conversion unit 15 performs black-insertion-data conversion on the pixel data items that have been gamma-corrected by the gamma correction unit 14.

The display panel control circuit CNT further includes a compensation-voltage generating circuit 6 and a gradation-reference voltage generating circuit 7. The compensation-voltage generating circuit 6 generates compensation voltage Ve. The compensation voltage Ve is applied through the gate driver YD to a gate line Y immediately preceding any gate line Y that is connected to the switching elements W of one low when these elements W are off. The compensation voltage Ve compensates for a change of pixel voltage Vs, which occurs in the pixels PX of one row duce to the parasitic capacitance of the switching elements W. The gradation-reference voltage generating circuit 7 generates a prescribed number of gradation-reference voltages VREF. These gradation reference voltages VREF will be used to change video data DATA to a pixel voltage Vs.

As will be described later in detail, a temperature sensor 20 is connected to the black-insertion-timing control unit 13. The sensor 20 can detect the temperature of the liquid crystal display panel DP.

The OCB liquid crystal used in the liquid crystal display panel DP will be described with reference to FIG. 2.

Figure 2:
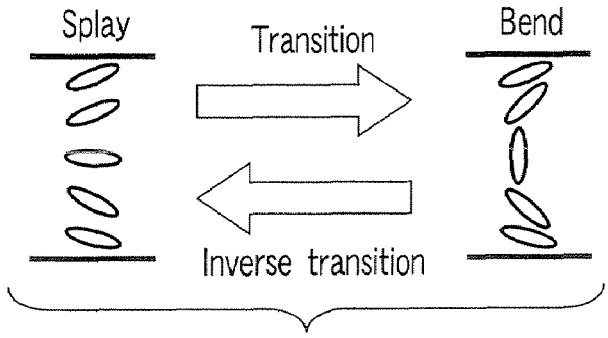
FIG. 2 is a diagram illustrating the alignment state of liquid crystal molecules of OCB liquid crystal.

FIG. 2 illustrates the two alignment states that liquid crystal molecules of the OCB liquid crystal can assume, namely splay alignment and bend alignment. Generally, the splay alignment is more stable than the bend alignment, as long as no voltage is applied to the liquid crystal layer. When a sufficiently high voltage is applied to the liquid crystal layer, however, the bend alignment is more stable than the splay alignment. In most cases, the OCB mode is used while assuming the bend alignment. Hence, a high voltage is applied for some time after the power switch of the display is turned on, thus changing the alignment state from splay alignment to bend alignment. Note that the state transition from splay alignment to bend alignment is called "transition," and the state transition from bend alignment to splay alignment is called "inverse transition."

The stability of liquid-crystal alignment will be explained in greater detail.

Figure 3A:
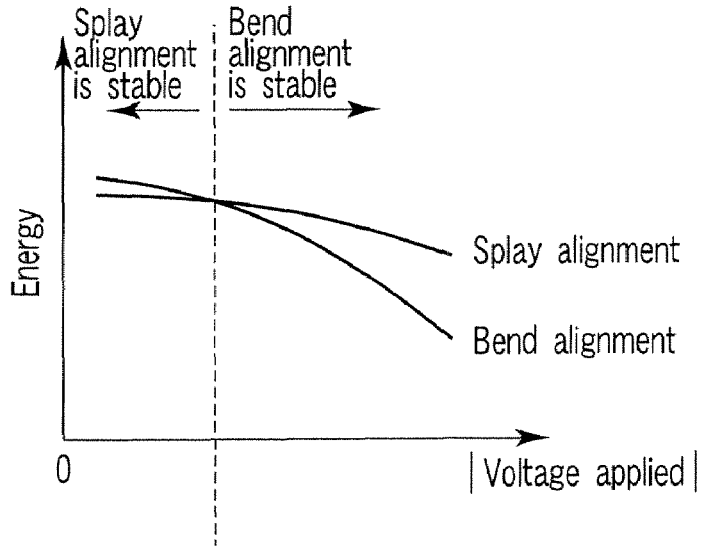
FIG. 3A is a graph showing how the energy changes with the voltage applied while the OCB liquid crystal molecules remain in splay alignment, and while the OCB liquid crystal molecules remain in bend alignment.

FIG. 3A shows how the free energy changes with the voltage applied while the OCB liquid crystal molecules remain in splay alignment, and how it changes with the voltage while the OCB liquid crystal molecules remain in bend alignment. Both curves shown in FIG. 3A cross a line indicating a certain voltage value Vc (hereinafter called critical voltage). In the low-voltage region on the left-hand side of the line, the energy is smaller in the splay alignment than in the bend alignment. In the high-voltage region on the right-hand side of the line, the energy is smaller in the bend alignment than in the splay alignment.

Figure 3B:
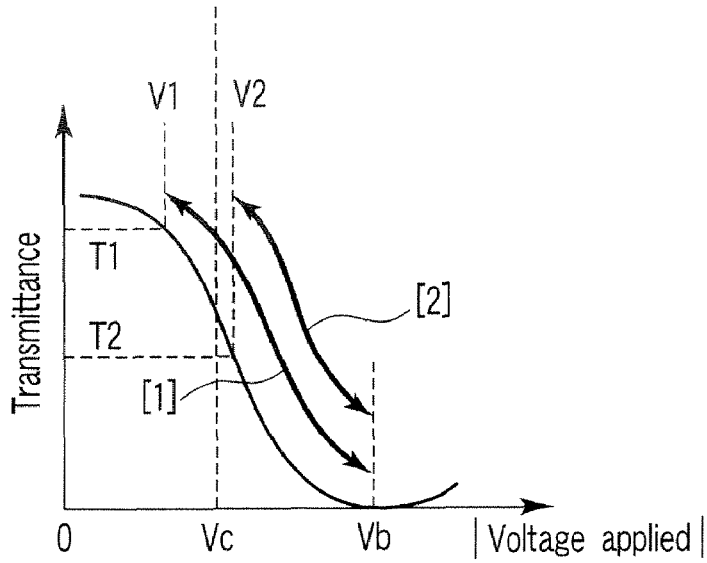
FIG. 3B is a graph showing how the transmittance of an OCB liquid crystal layer changes with the voltage applied to the layer, while the OCB liquid crystal molecules remain in bend alignment.

FIG. 3B shows how the transmittance of the OCB liquid crystal layer changes with the voltage applied to the layer, while the OCB liquid crystal molecules remain in bend alignment. The voltage Vb at which the transmittance is minimal is called black voltage. In order to increase the transmittance in the white display mode, the dynamic range of the voltage applied to the liquid crystal layer should be as broad as possible. The voltage should range, for example, from V1 to Vb, as indicated by curve [1] in FIG. 3B.

However, the voltage V1 applied in the white-display mode is lower than critical voltage Vc. Therefore, the alignment state undergoes inverse transition, changing from the bend alignment to the stable splay alignment. Consequently, the image displayed will have defects. To prevent the inverse transition, a voltage ranging from V2 to Vb must be applied to the liquid crystal layer, as indicated by curve [2] in FIG. 3B, at some expense of the transmittance, thereby setting voltage V2 for the white-display mode, to a value greater than the critical voltage Vc.

Black-insertion driving has been devised as a drive scheme that imparts high transmittance to the liquid crystal layer as indicated by curve [1] in FIG. 3B and that causes no inverse transition of alignment state. In an ordinary black insertion driving, the liquid crystal layer is driven in signal-display mode (i.e., white display) for 80% of the one-frame period, and in black display mode (i.e., black insertion) for the remaining 20% of the one-frame period.

Figure 4:
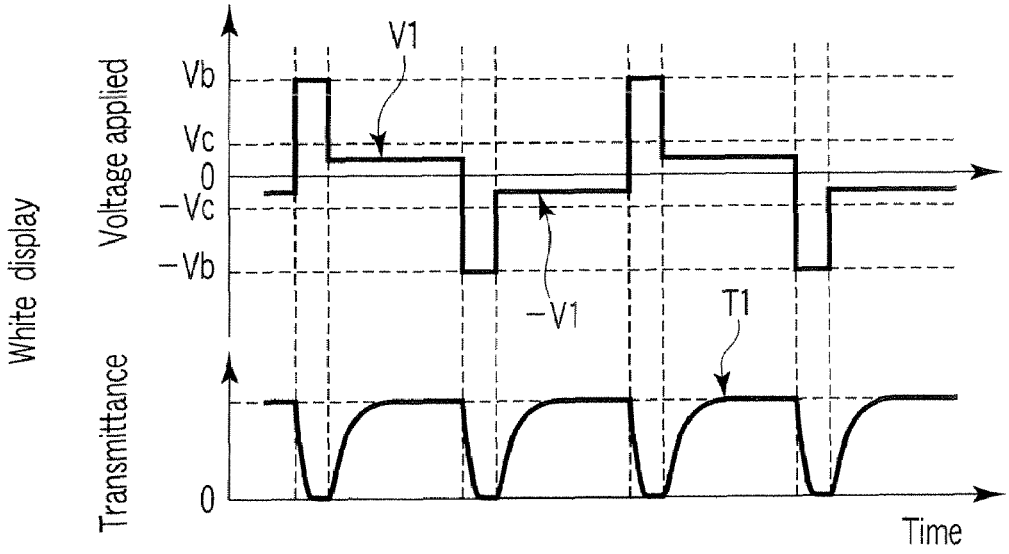
FIG. 4 is a timing chart explaining the relation between the voltage applied to the panel shown in FIG. 1 and the transmittance of the panel, said relation observed when the panel is driven in the black-insertion driving during the white-display period.
Figure 5:
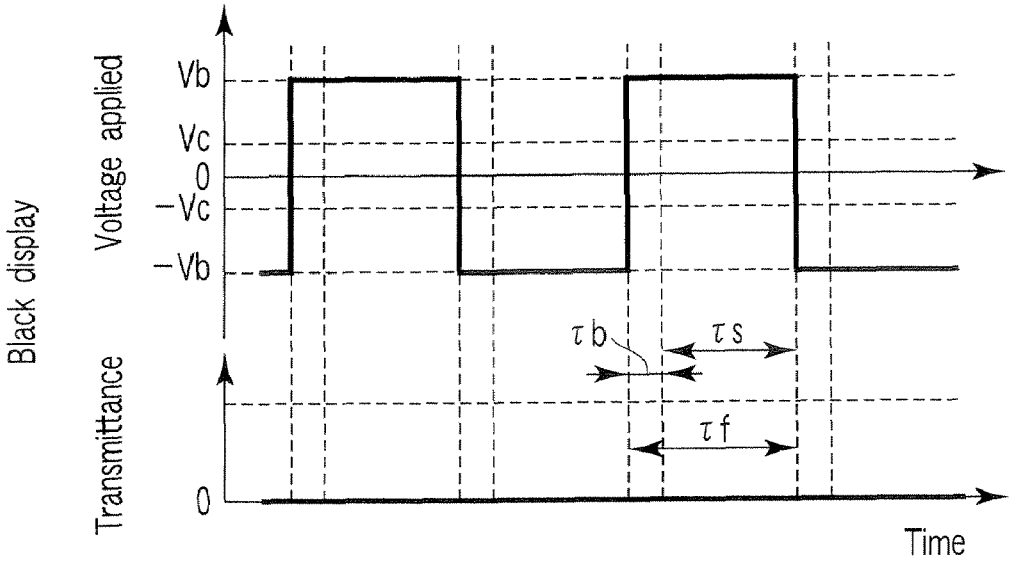
FIG. 5 is a timing chart explaining the relation between the voltage applied to the panel shown in FIG. 1 and the transmittance of the panel, said relation observed when the panel is driven in the black-insertion driving during the black-display period.

FIG. 4 and FIG. 5 show the timing of the black-insertion driving that is performed in the liquid crystal display panel DP, in the white-display mode and the black-display mode, respectively. In FIG. 5, the period $\tau f$ is equivalent to the one-frame period. The period $\tau f$ consists of periods $\tau s$ and $\tau b$. The period $\tau s$ is a signal-display period, and period $\tau b$ is a black-insertion period. Voltage Vb and critical voltage Vc shown in FIGS. 4 and 5 correspond to the black voltage and critical voltage that are shown in FIG. 3B, respectively.

The white display shown in FIG. 4 will be described. In the black-insertion period, a signal at voltage ±Vb is applied to the liquid crystal layer. As a result, the transmittance of the liquid crystal layer becomes to almost 0. In a signal-display period, the voltage corresponding to white display (i.e., ±V1 is lower than critical voltage Vc) is applied to the liquid crystal layer. As result, the transmittance (T1 shown in FIG. 4) will correspond to the voltage applied. The liquid crystal molecules respond, with some delay, to the stepwise change in voltage. Therefore, the wave representing the change of transmittance is somewhat blunt as is illustrated in FIG. 4.

To perform black display, voltage ±Vb is applied not only in the black-display period, but also in the signal-display period. In this case, the transmittance becomes almost 0 in both the black-display period and the signal-display period.

In this driving, a signal of voltage ±Vb is intermittently supplied even if the voltage applied to the liquid crystal layer falls below the critical voltage Vc as the white display proceeds. Thus, the alignment state is changed back to the bend alignment. The liquid crystal display panel DP can therefore reliably operate, without causing inverse transition.

The black-non-insertion driving of the display panel DP will be explained, in comparison with the black-insertion driving.

Figure 6:
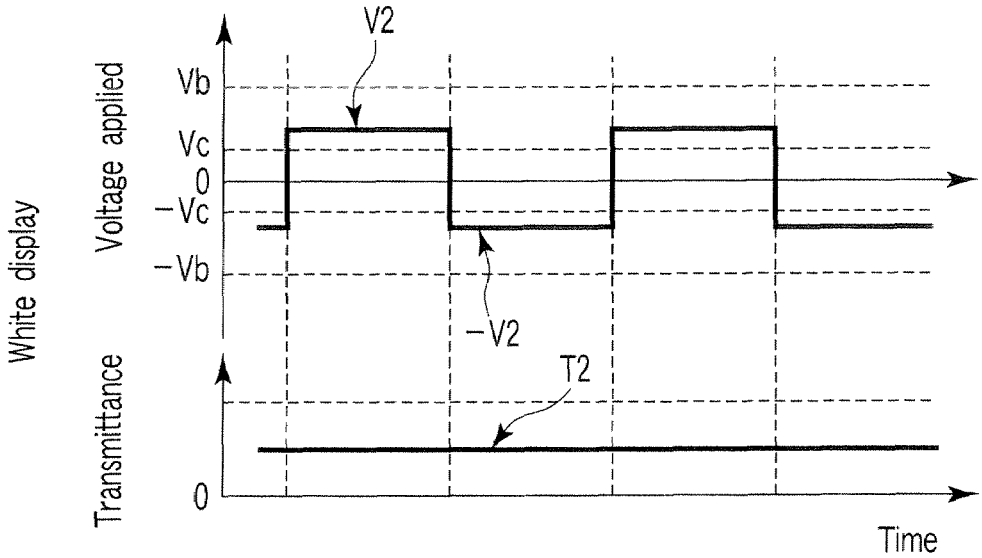
FIG. 6 is a timing chart explaining the relation between the voltage applied to the panel shown in FIG. 1 and the transmittance of the panel, said relation observed when the panel is not driven in the black-insertion driving during the white-display period.
Figure 7:
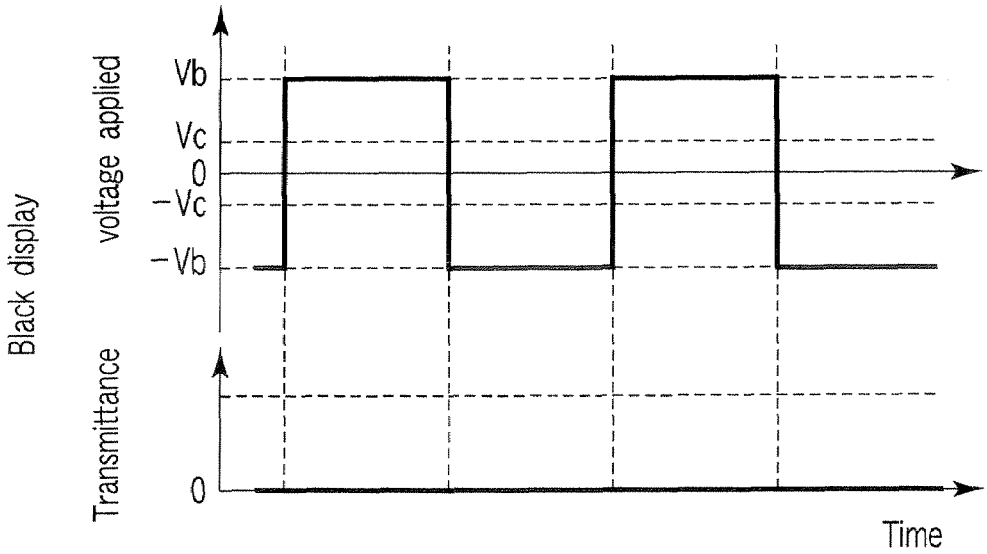
FIG. 7 is a timing chart explaining the relation between the voltage applied to the panel shown in FIG. 1 and the transmittance of the panel, said relation observed when the panel is not driven in the black-insertion driving during the black-display period.

FIG. 6 and FIG. 7 show the timing of the black-non-insertion driving that is performed in the liquid crystal display panel DP, in the white-display mode and the black-display mode, respectively.

In this driving, the entire one-frame period is a signal indication period. In the white-display mode (FIG. 6), for example, the transmittance is T2 that corresponds to the voltage V2. In the black-display mode (FIG. 7), the transmittance corresponds to voltage Vb (almost 0).

In the black-insertion driving, the transmittance remains 0 for the black-insertion period. As a result, the transmittance averaged in terms of time is somewhat low. Nonetheless, the transmittance is greatly improved during the display period, thanks to the low voltage for the white display. In total, the transmittance can be higher in the black-insertion driving than in the black-non-insertion driving. The black-insertion driving can achieve an additional advantage, namely improved visibility of moving pictures.

As mentioned above, the black-insertion driving is advantageous in that a high transmittance is obtained. However, it has the problem that the transmittance falls at low temperatures (0° C., more or less).

Figure 8:
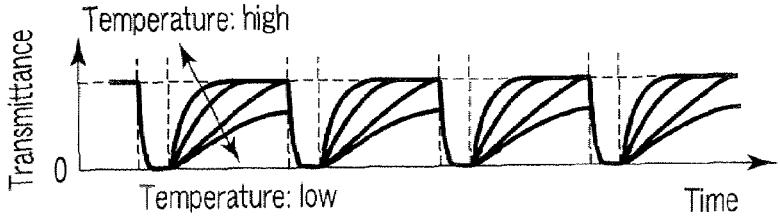
FIG. 8 is a timing chart explaining how the transmittance of the panel of FIG. 1 changes with the temperature of the panel.

FIG. 8 shows how the transmittance of the liquid crystal display panel changes with the temperature of the panel. That is, the transmittance relatively fast follows the change of the voltage at temperatures near room temperature. At low temperatures, however, its response is slow due to the increase in the viscosity of liquid crystal. As shown in FIG. 8, the response waveform of transmittance becomes blunt, and the transmittance decreases.

The present invention solves the problem that the transmittance falls at such low temperatures.

Figure 9:
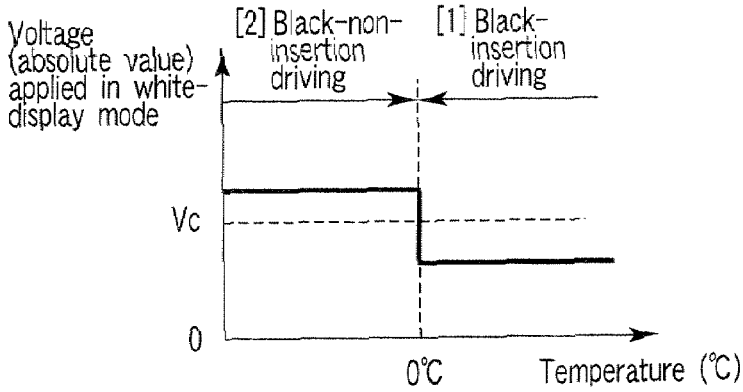
FIG. 9 is a diagram illustrating how the liquid crystal display panel according to an example of the embodiment of this invention is driven and controlled, and showing the relation between the temperature of the panel and the voltage applied to the panel.

FIG. 9 illustrates how the liquid crystal display panel DP according to the example of the embodiment of this invention is driven and controlled.

When the temperature is higher than a certain value (e.g., 0° C.), the panel PD is driven in black-insertion driving as shown at [1] in FIG. 9. When the temperature is lower than the above-mentioned value, the panel PD is driven in black-non-insertion driving as shown at [2] in FIG. 9. That is, the voltage applied during white display falls below the critical voltage Vc at any temperature higher than 0° C. The voltage is equal to or higher than the critical voltage Vc at any temperature equal to or lower than 0° C. In practice, the voltage applied during white display falls below Vc, or is equal to or higher than −Vc, if the temperature is higher than 0° C. Alternatively, the voltage applied during white display falls below −Vc, or is equal to or higher than Vc, if the temperature is lower than 0° C.

Thus, at temperatures higher than 0° C., the liquid crystal display panel DP can obtain high transmittance when drive and controlled as described above. At temperatures lower than 0° C., too, the panel DP can have high transmittance, because the transmittance is not influenced by such a slow response as shown in FIG. 8.

To perform the control described above, the black-insertion-timing control unit 13 of the controller 5, shown in FIG. 1, changes the control conditions in accordance with the temperature of the liquid crystal display panel DP, which the temperature sensor 20 has detected.

Figure 10A:
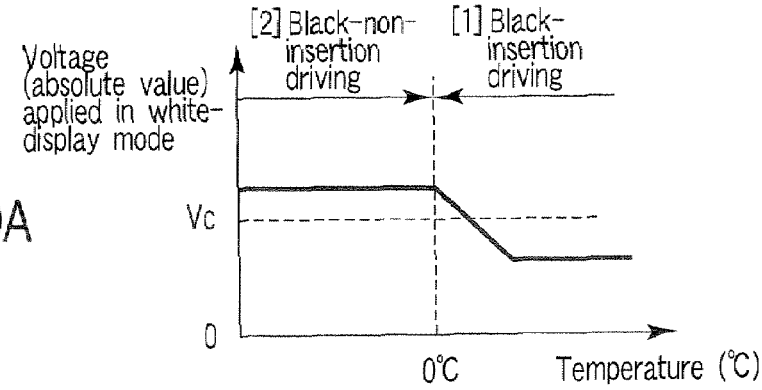
FIG. 10A is a diagram illustrating how a liquid crystal display panel according to another example of the embodiment of this invention is driven and controlled, and showing the relation between the temperature of the panel and the voltage applied to this panel.
Figure 10B:
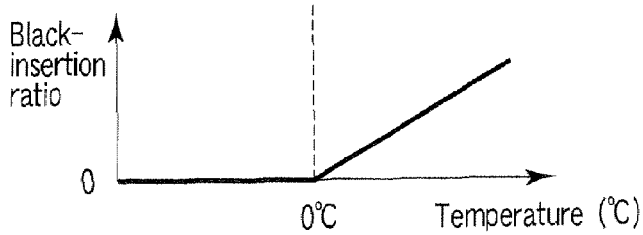
FIG. 10B is a diagram illustrating how the liquid crystal display panel according to the other example of the embodiment is driven and controlled in another manner, and showing the relation between the temperature of the panel and the voltage applied to this panel.

FIG. 10A and FIG. 10B show how a liquid crystal display panel DP according to another example o the embodiment of this invention is driven and controlled.

The control is fundamentally identical to the control shown in FIG. 9. It differs in that the drive conditions are changed continuously.

The drive mode is not switched at a specific temperature, from the black-insertion driving to the black-non-insertion driving, or vice versa, as shown in FIG. 9. Instead, as shown in FIG. 10B, the black-insertion ratio is continuously changed. In the white-display mode, too, the voltage is continuously changed as illustrated in FIG. 10A.

When the liquid crystal display panel DP is so controlled as described above, the displaying condition (brightness) on the screen continuously changes, not abruptly, even if the temperature of the panel DP changes. Hence, the user of the liquid crystal display panel DP feels nothing wrong with the images displayed. The panel DP can be driven as shown in FIG. 10A or FIG. 10B by means of a combination of a temperature sensor and a controller.

More specifically, in the configuration of FIG. 1, the black-insertion-timing control unit 13 of the controller 5 only needs to change the drive conditions continuously, in accordance with the temperature of the liquid crystal display panel DP, which the temperature sensor 20 has detected.

The panel DP can be driven as shown in FIG. 10A or 10B, too, in order to accomplish, for example, field-sequence driving.

As has been described above, the liquid crystal display apparatus according to the embodiment of this invention needs to comprise only the liquid crystal display panel DP, the temperature sensor 20 that detects the temperature of the panel DP, and the controller 5 that controls the voltage applied to the liquid crystal display panel DP. The controller 5 needs only to set the black-insertion ratio is 0% and change the voltage applied in the white-display mode to a voltage higher than the critical voltage Vc, in accordance with the temperature detected by the sensor 20. Alternatively, the controller needs only to set the black-insertion ratio to a finite value and change the voltage applied in the white-display mode to a voltage lower than the critical voltage Vc, in accordance with the temperature detected by the sensor 20.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An OCB liquid crystal display apparatus comprising:

a liquid crystal display panel;

a temperature sensor which detects temperature of the liquid crystal display panel; and a controller which controls a voltage applied to the liquid crystal display panel, the controller being configured to set a black-insertion ratio to 0% and change the voltage applied in white-display mode to a voltage equal to or higher than the critical voltage when the temperature detected by the temperature sensor is at most a given temperature and to set a black-insertion ratio to a non-zero value and change the voltage applied in the white-display mode to a voltage lower than the critical voltage when the temperature detected by the temperature sensor is higher than the given temperature.

2. The apparatus according to claim 1, wherein said given temperature is 0° C.

3. The apparatus according to claim 1, wherein the controller continuously changes the non-zero value and the voltage applied in the white-display mode in accordance with the temperature detected by the temperature sensor.

* * * * *